US005967425A

United States Patent [19]

Wang

[11] Patent Number: 5,967,425

[45] Date of Patent: Oct. 19, 1999

[54] AIR BLAST APPARATUS FOR YARN DRAWING MACHINES

[76] Inventor: Shoei-Yuan Wang, P.O. Box 82-144, Taipei, Taiwan

[21] Appl. No.: 08/934,809

[22] Filed: Sep. 22, 1997

[51] Int. Cl.[6] ..... B05B 1/02

[52] U.S. Cl. ..... 239/590.3; 239/591

[58] Field of Search ..... 239/589, 590, 239/590.3, 591

[56] References Cited

U.S. PATENT DOCUMENTS 4,502,304 3/1985 Hopkins ..... 239/590.3 X 5,609,305 3/1997 Webb ..... 239/590.3

*Primary Examiner*—Andres Kashnikow

*Assistant Examiner*—Lisa A. Douglas

[57] ABSTRACT

An improved air blast apparatus for yarn drawing machines includes a main pipe, a guide pipe, and a polygonal draft box coaxially mounted on the guide pipe. The guide pipe has a throat portion, whereas the draft box has a blast nozzle 180 degrees apart from the throat portion. Such a design and the arrangement of the angles of the draft box help interfere with the air currents inside the draft box so that the air pressure may be more evenly distributed.

2 Claims, 7 Drawing Sheets

AIR BLAST APPARATUS FOR YARN DRAWING MACHINES

BACKGROUND OF THE INVENTION

1. Field of the Invention

This invention relates generally to an air blast apparatus, and more particularly to an air blast apparatus for yarn drawing machines in which the blast effects are enhanced.

2. Description of the Prior Art

FIG. 1 illustrates a conventional air blast apparatus 10 used in yarn drawing machines. It comprises a tubular guide pipe 11 which has a peripheral wall provided with a throat portion 111. A blast nozzle 12 having a blast outlet 121 extends from a front end of the throat portion 111. High pressure introduced from two ends 112 of the guide pipe 11 blows out from both side sections 122 of the blast outlet 121 and does not reach the middle section 123 of the pipe. In order that the draft blows out from the whole length of the blast outlet 121, the draft pressure has to be increased. However, there will still be high pressure at both side sections 122 and low pressure at the middle section 123.

SUMMARY OF THE INVENTION

This invention relates generally to an air blast apparatus, and more particularly to an air blast apparatus for yarn drawing machines in which the blast effects are enhanced.

Accordingly, a primary object of the present invention is to provide an improved air blast apparatus in which a polygonal draft box is coaxially mounted on a guide pipe. The guide pipe has a throat portion that is a 180 degrees apart from a blast nozzle of the draft box. Such a design and the angles of the draft box eliminates the difference in air pressure within the draft box so that the blast may be sent out more uniformly and forcefully.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

Many other advantages and features of the present invention will become manifest to those versed in the art upon making reference to the detailed description and the accompanying sheets of drawings in whch a preferred structural embodiment incorporating the principles of the present invention is shown by way of illustrative example.

DETAILED DESCRIPTION OF THE PREFERRED EMBODIMENT

Figure 1:
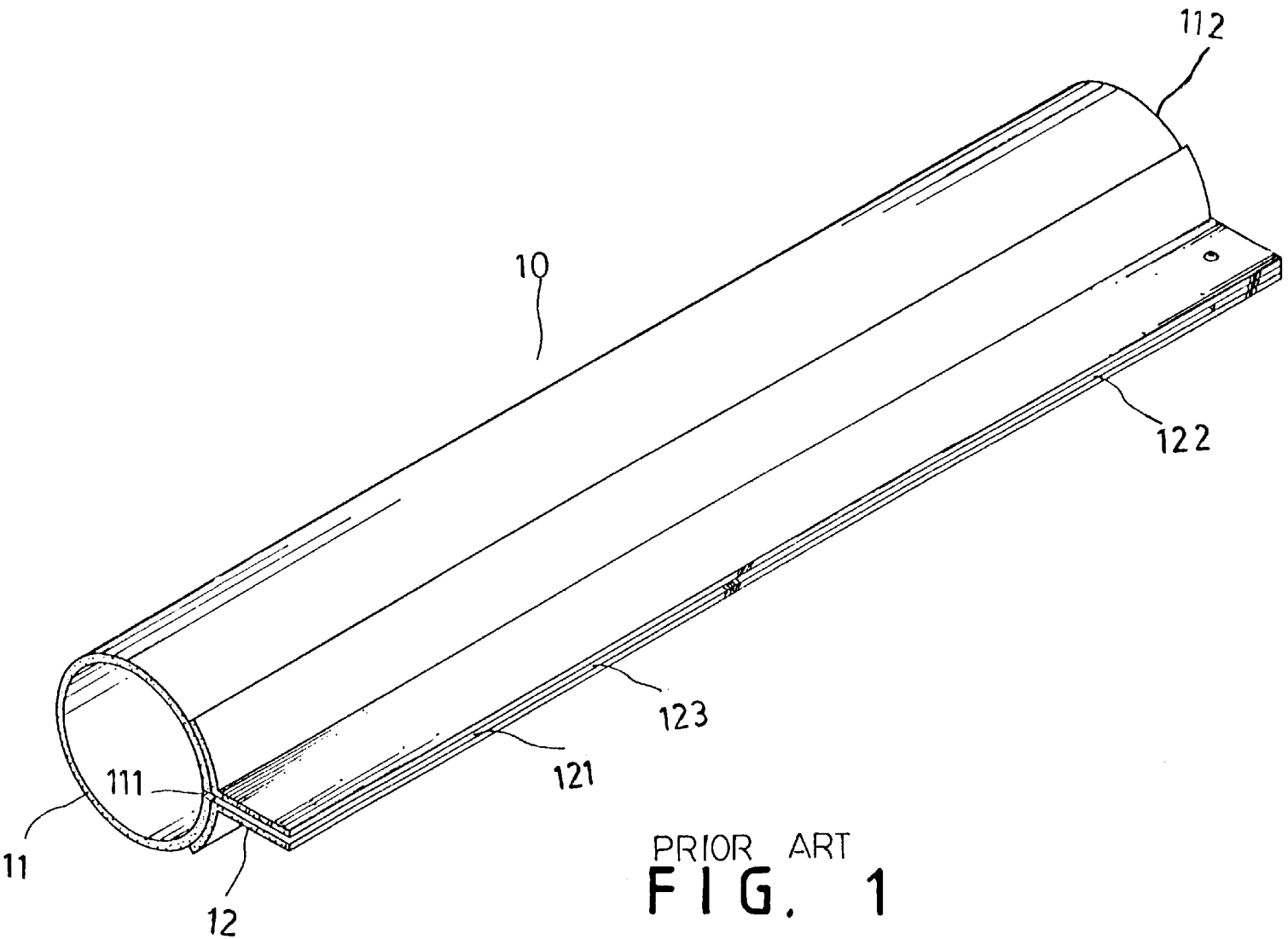
PRIOR ART FIG. 1
FIG. 1 is a perspective sectional schematic view of the prior art.
Figure 2:
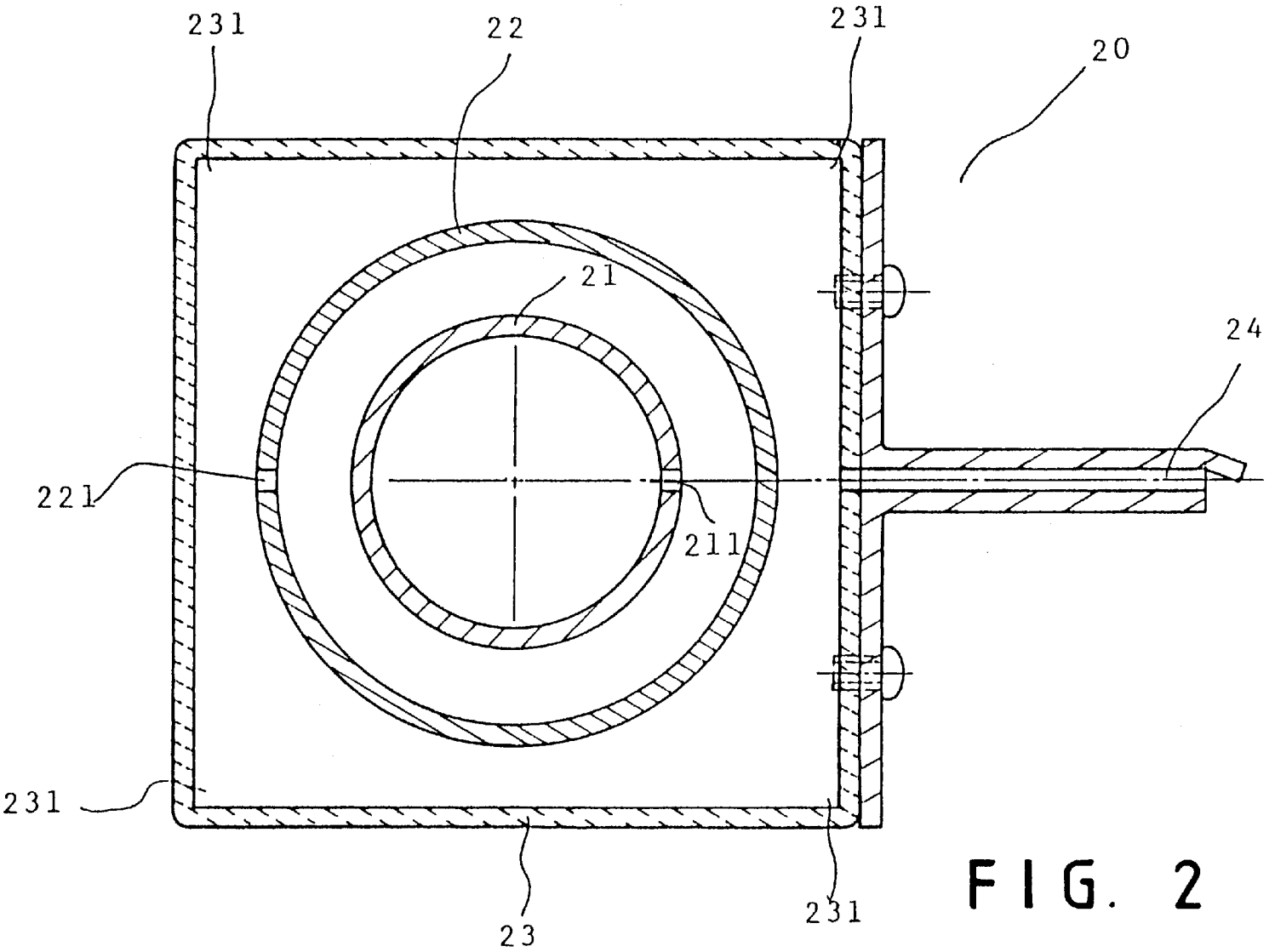
FIG. 2 is a sectional schematic view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to FIGS. 2, 3, 4 and 5, the air blast system according to the present invention comprises an air blast apparatus 20 that includes a main pipe 21 and a guide pipe 22 coaxially mounted around the main pipe 21. The main pipe 21 and the guide pipe 22 respectively have throat portions 211, 221 for guiding the blast. The throat portions 211, 221 are configured to guide the air currents to flow in opposite directions, i.e., through 180 degrees.

There is further provided a polygonal draft box 23 with a plurality of angles 231 that is coaxially mounted around the guide pipe 22. The angles 231 are capable of interfering with the flow of air currents inside the draft box 23 so that the air pressure may be more evenly distributed and the air currents may flow uniformly out of a blast nozzle 24.

Figure 3:
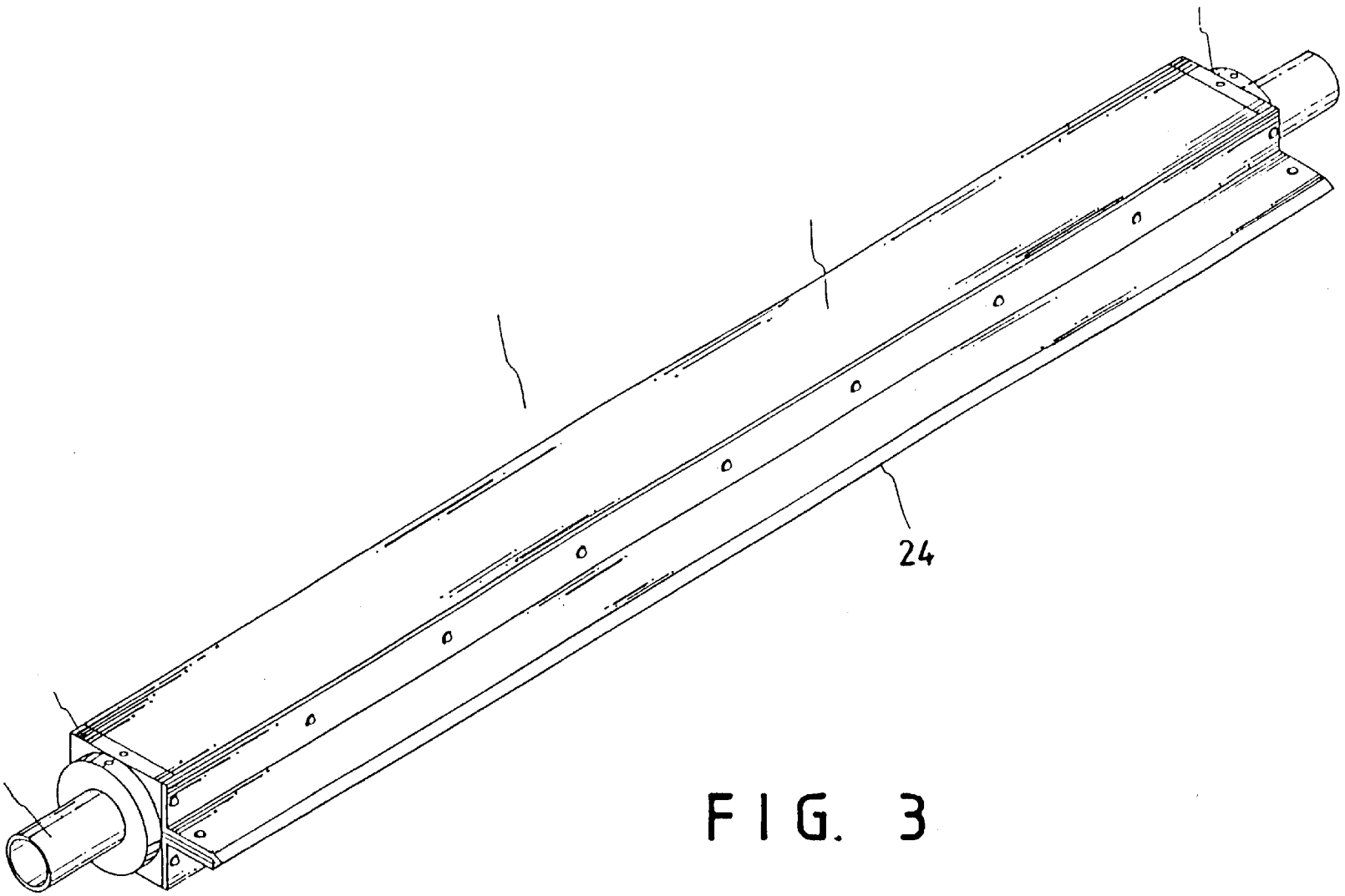
FIG. 3 is a perspective view of the present invention.
Figure 4:
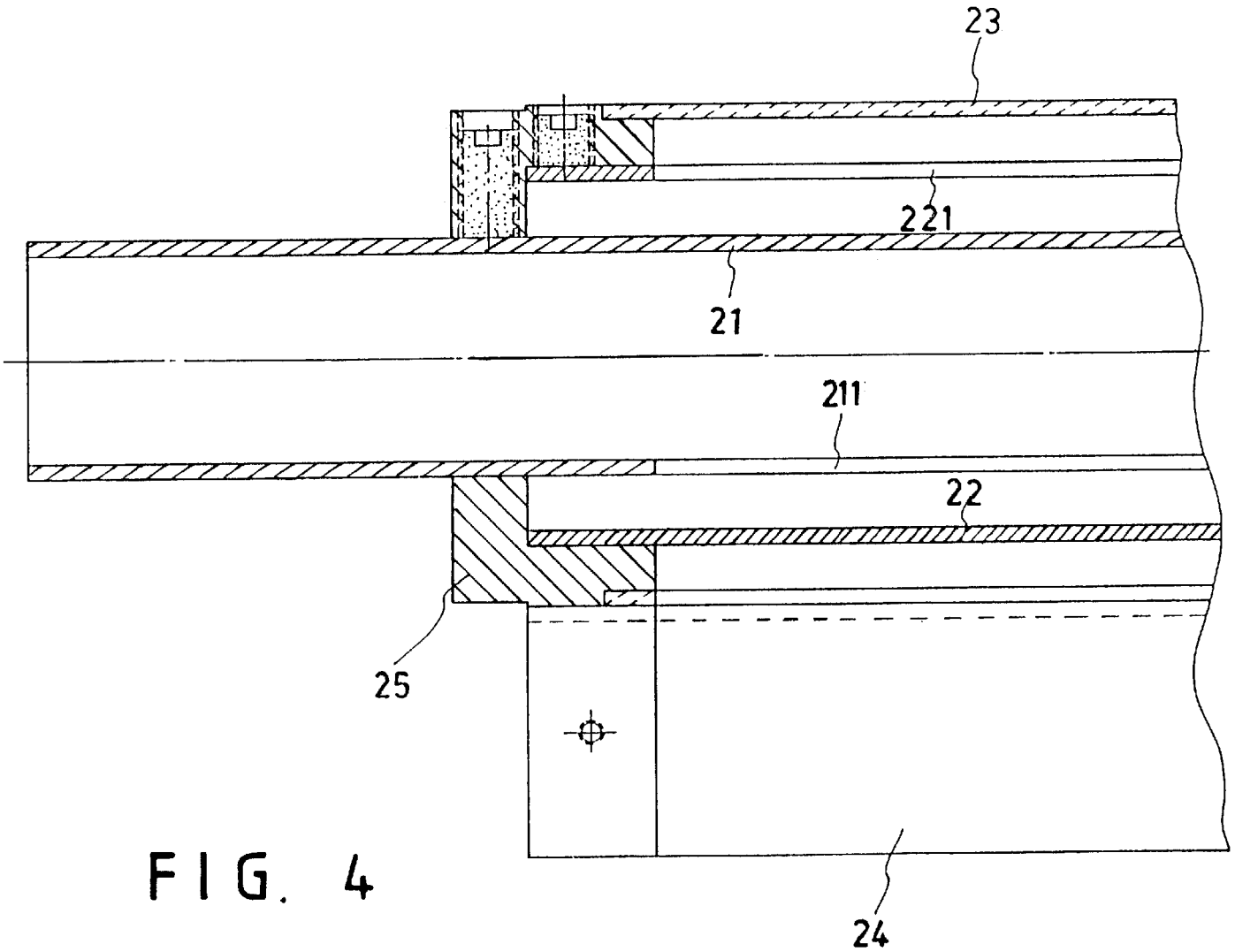
FIG. 4 is a sectional schematic view of the end portions of the present invention.
Figure 5:
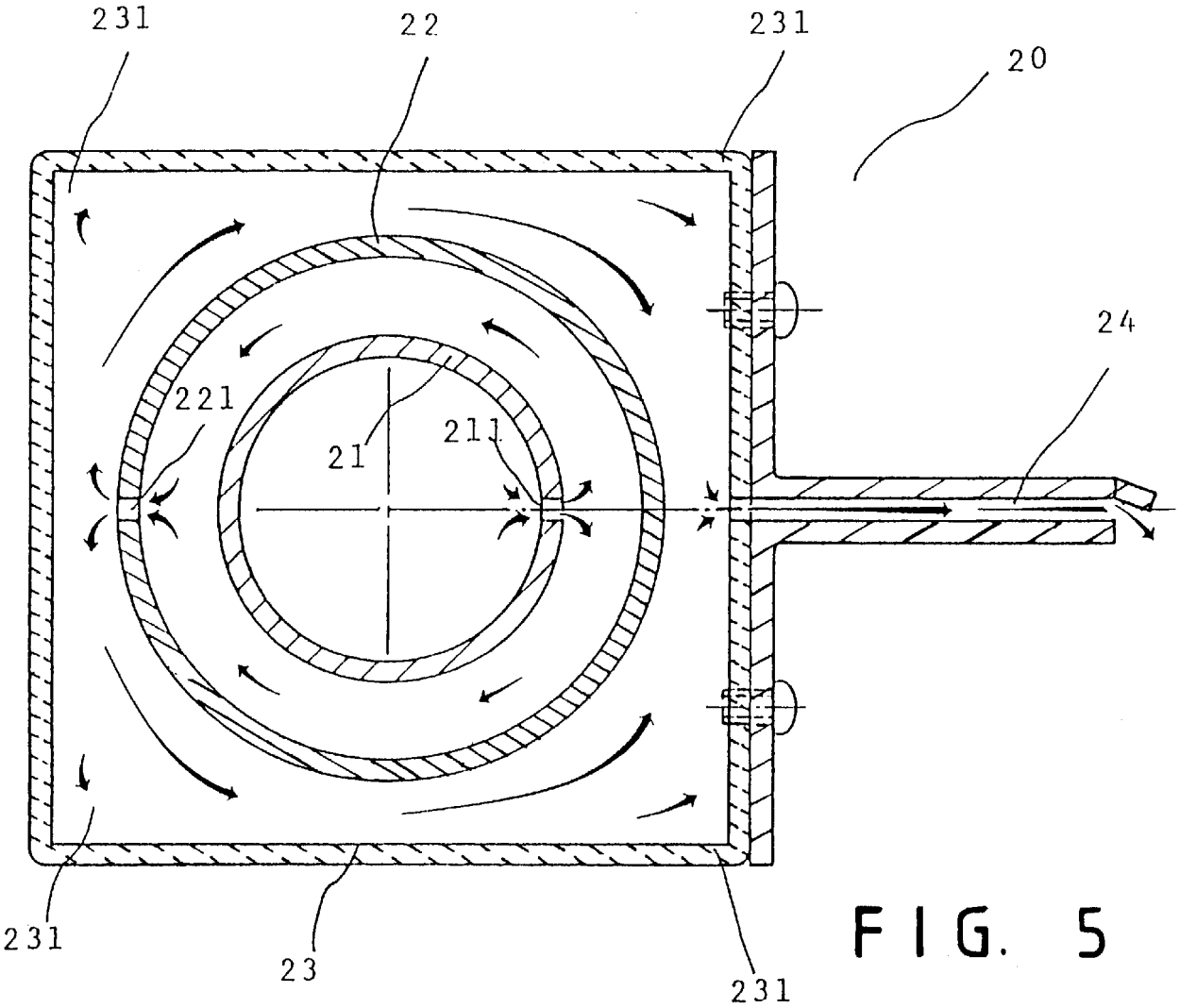
FIG. 5 is a schematic view illustrating the flow of currents in the present invention.

Referring to FIGS. 3 and 4, the ends of the main pipe 21, the guide pipe 22, and the blast box 23 are closed by using multi-stepped terminals 25 such that the ends of the innermost main pipe 21 project from the two terminals 25 to connect to a blast blower (not shown) for guiding in high pressure air currents.

Figure 6:
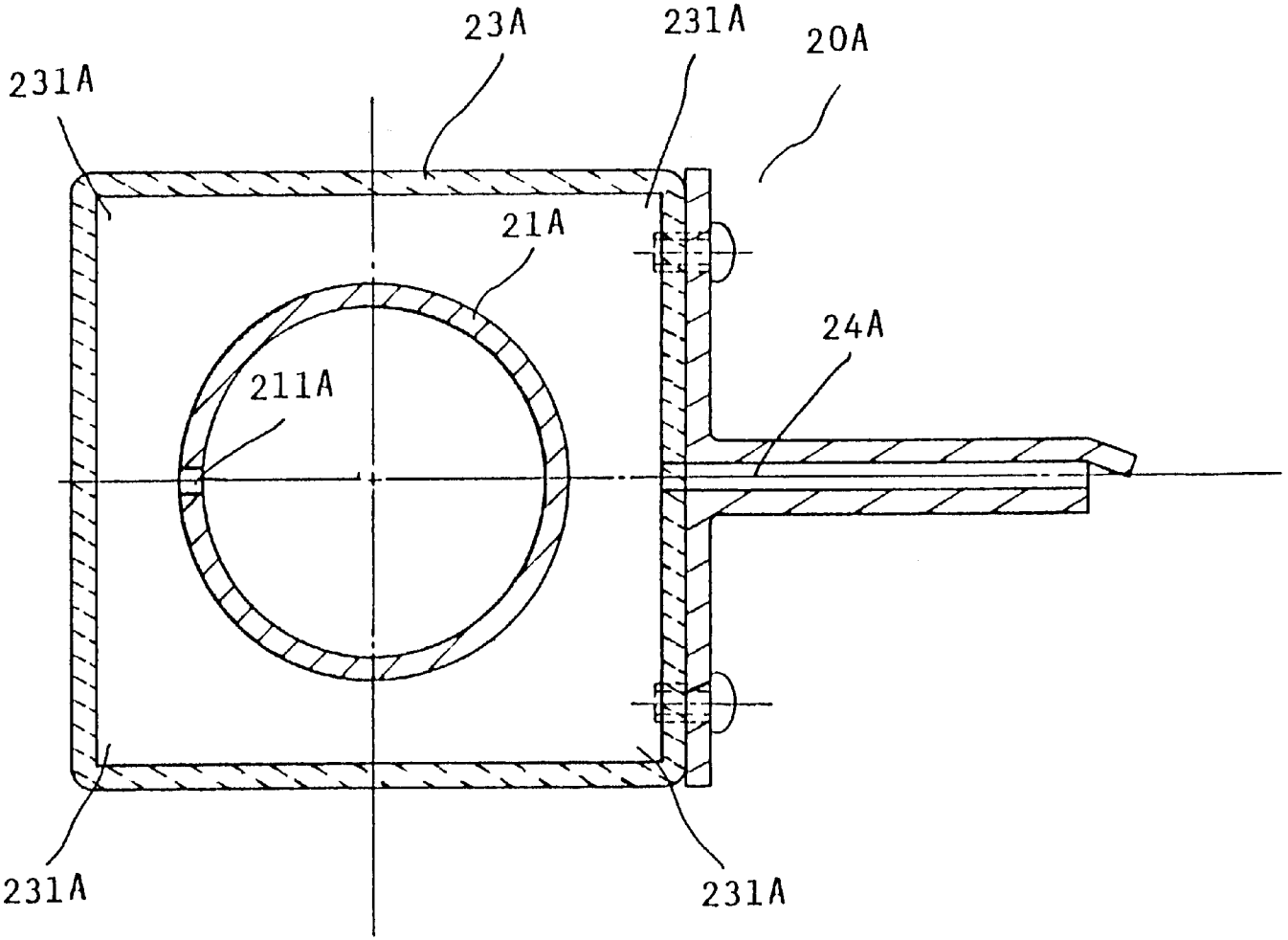
FIG. 6 is a sectional schematic view of another preferred embodiment of the present invention.
Figure 7:
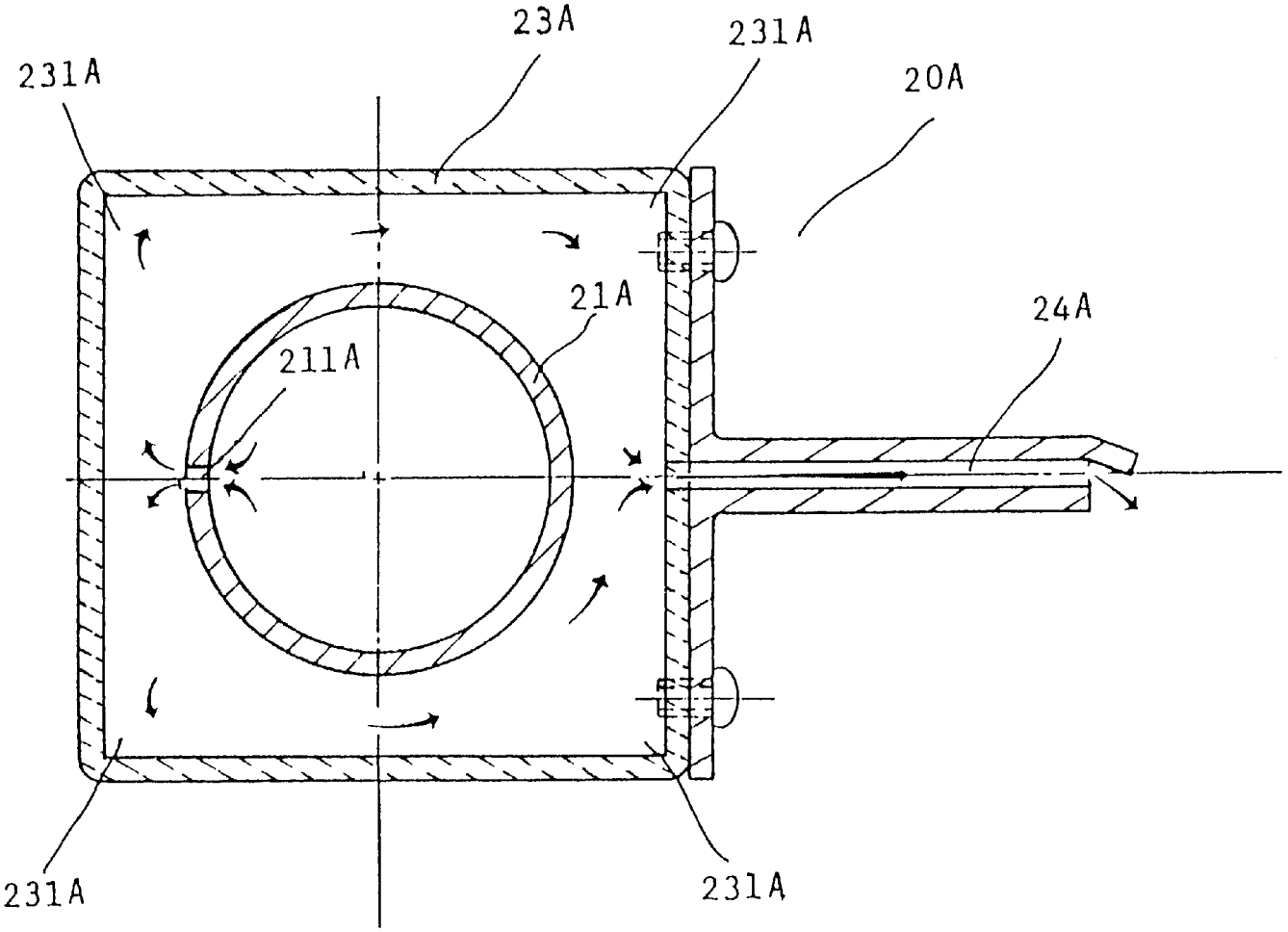
FIG. 7 is a schematic view of the flow of currents in the preferred embodiment shown in FIG. 6.

FIGS. 6 and 7 show another preferred embodiment of the present invention. An air blast apparatus 20A may be provided with a main pipe 21A and a polygonal draft box 23A having angles 231A coaxially mounted around the main pipe 21A. The main pipe 21A has a throat portion 211A, whereas the draft box 23A has a blast nozzle 24A. The throat portion 211A is disposed 180 degrees apart from the blast nozzle 24A so that the blast comes out in two opposite directions.

In view of the above, the present invention is capable of eliminating the drawbacks with the prior art. The polygonal draft box coaxially mounted on the blast pipe, and the arrangement of the throat portion that is 180 degrees apart from the blast nozzle eliminate the uneven distribution of air pressure inside the draft box so that the blast may come out more smoothly and the amount of blast may increase.

It should be appreciated that the number, shape and orientation of the angles 231 of the draft box 23 may vary as needed. Besides, the guide pipe 22 may have a plurality of layers.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An air blast apparatus for yarn drawing machines, comprising a main pipe;

a guide pipe mounted around the main pipe, said guide pipe having a throat portion, and a throat of said main pipe being 180 degrees apart from said throat portion of said guide pipe for blowing out a turbulent air current; and a polygonal draft box having angles, said draft box being coaxially mounted around said guide pipe, the angles of said draft box being capable of interfering with high pressure air currents inside said draft box so that the air pressure moves more uniformly and the blast from the air blast apparatus is more even.

2. An air blast apparatus for yarn drawing machines as claimed in claim 1, wherein said guide pipe comprises a plurality of layers.

* * * * *